US009209552B2

(12) United States Patent
Bröcker

(10) Patent No.: US 9,209,552 B2
(45) Date of Patent: Dec. 8, 2015

(54) CONNECTION MODULE AND CONNECTION MODULE SYSTEM

(71) Applicant: Beckhoff Automation GmbH, Verl (DE)

(72) Inventor: Rainer Bröcker, Wülfrath (DE)

(73) Assignee: BECKHOFF AUTOMATION GMBH, Verl (DE)

( * ) Notice: Subject to any disclaimer, the term of this patent is extended or adjusted under 35 U.S.C. 154(b) by 237 days.

(21) Appl. No.: 13/922,791

(22) Filed: Jun. 20, 2013

(65) Prior Publication Data

US 2013/0344750 A1 Dec. 26, 2013

Related U.S. Application Data

(63) Continuation of application No. PCT/EP2011/070971, filed on Nov. 24, 2011.

(30) Foreign Application Priority Data

Dec. 22, 2010 (DE) ..... 10 2010 063 978

(51) Int. Cl.
*H01R 13/514* (2006.01)
*H01R 4/48* (2006.01)
(Continued)

(52) U.S. Cl.
CPC ..... *H01R 13/514* (2013.01); *H01R 4/4845* (2013.01); *H01R 9/2458* (2013.01); *H01R 13/71* (2013.01); *H01H 1/26* (2013.01); *H01H 2001/265* (2013.01); *H01R 9/2675* (2013.01)

(58) Field of Classification Search
CPC .... H01R 9/2675; H01R 4/4845; H01R 13/71; H01H 1/26
USPC ..... 439/835, 441, 712
See application file for complete search history.

(56) References Cited

U.S. PATENT DOCUMENTS 2,713,668 A * 7/1955 Gibilisco ..... 439/438
2,720,634 A * 10/1955 Hart ..... 439/441
(Continued)

FOREIGN PATENT DOCUMENTS

DE 962454 C 4/1957
DE 196 50 989 A1 6/1998
(Continued)

OTHER PUBLICATIONS

International Search Report issued in connection with International Patent Application No. PCT/EP2011/070971. Mailed Apr. 20, 2012. 14 pages.
(Continued)

*Primary Examiner* — Briggitte R Hammond
(74) *Attorney, Agent, or Firm* — Dorsey & Whitney LLP

(57) ABSTRACT

A connection module and to a connection module system for supplying a drive module with electrical current, the connection module including a first connecting contact and a second connecting contact, wherein the first and the second connecting contacts each have a contact element, wherein the first contact element of the first connecting contact is arranged in a movable manner and the second contact element of the second connecting contact is arranged in a fixed manner, wherein the second contact element of the second connecting contact is configured to provide a connection to a corresponding first contact element of an adjacent module, wherein the second connecting contact includes a spring terminal configured to press the corresponding first contact element of the adjacent module against the second contact element of the second connecting contact.

14 Claims, 6 Drawing Sheets

(51) Int. Cl.

| | |
|---|---|
| ***H01R 9/24*** | (2006.01) |
| ***H01R 13/71*** | (2006.01) |
| *H01H 1/26* | (2006.01) |
| *H01R 9/26* | (2006.01) |

(56) References Cited

U.S. PATENT DOCUMENTS

| | | | | |
|---|---|---|---|---|
| 3,579,283 | A * | 5/1971 | Welburn | 439/325 |
| 5,879,204 | A * | 3/1999 | Delarue et al. | 439/835 |
| 5,915,991 | A * | 6/1999 | Roman | 439/441 |
| 6,004,168 | A * | 12/1999 | Fuchs et al. | 439/835 |
| 6,336,824 | B1 * | 1/2002 | Sorig | 439/441 |
| 6,595,808 | B2 * | 7/2003 | Prost et al. | 439/834 |
| 6,663,441 | B1 * | 12/2003 | Alexandre et al. | 439/715 |
| 6,689,955 | B2 * | 2/2004 | Doutaz | 174/652 |
| 7,083,463 | B2 * | 8/2006 | Steinkemper et al. | 439/441 |
| 7,114,986 | B1 * | 10/2006 | Toly | 439/441 |
| 7,252,534 | B2 * | 8/2007 | Reibke | 439/404 |
| 7,485,015 | B2 * | 2/2009 | Coffy | 439/828 |
| 7,896,685 | B2 * | 3/2011 | Eppe et al. | 439/441 |
| 7,896,686 | B2 * | 3/2011 | Hoppe | 439/441 |
| 8,579,651 | B2 * | 11/2013 | Hanning et al. | 439/441 |
| 2005/0042912 | A1 * | 2/2005 | Drewes et al. | 439/441 |
| 2006/0063420 | A1 * | 3/2006 | Reibke et al. | 439/441 |
| 2007/0290778 | A1 * | 12/2007 | Stanke et al. | 335/202 |

FOREIGN PATENT DOCUMENTS

| | | | |
|---|---|---|---|
| DE | 29911124 | U1 | 8/2000 |
| DE | 29916302 | U1 | 3/2001 |
| DE | 103 25 956 | A1 | 3/2004 |
| DE | 103 04 324 | A1 | 8/2004 |
| DE | 697 113 | A5 | 4/2008 |
| DE | 10 2007 037797 | B4 | 6/2009 |
| DE | 20 2010 004 061 | U1 | 6/2010 |
| EP | 1833066 | A1 | 3/2006 |
| EP | 1 833 066 | A1 | 9/2007 |
| WO | 2005043685 | A2 | 5/2005 |
| WO | 2007107332 | A1 | 9/2007 |
| WO | 2010022955 | A1 | 3/2010 |

OTHER PUBLICATIONS

Search Report issued by German Patent Office in connection with German Patent Application No. 10 2010 063 978.8. Mailed Aug. 17, 2012. 10 pages.

Product Sheet for Verpacken aktuell. Retrieved from www.verpacken-aktuell.de on Dec. 22, 2010. (6 pages with translation).

Product Sheet for Schneider Electric ELAU Packaging Solutions (Lexium LxXM 62—universal servo amplifier for drive solutions with PacDrive3). Retrieved from www.elau.com/solutions/pacdrive-3/servoverstaerker on Dec. 22, 2010. (6 pages with translation).

English Translation of First Office Action for Counterpart CN Application (PRC Appl. No. 201180065350.0).

* cited by examiner

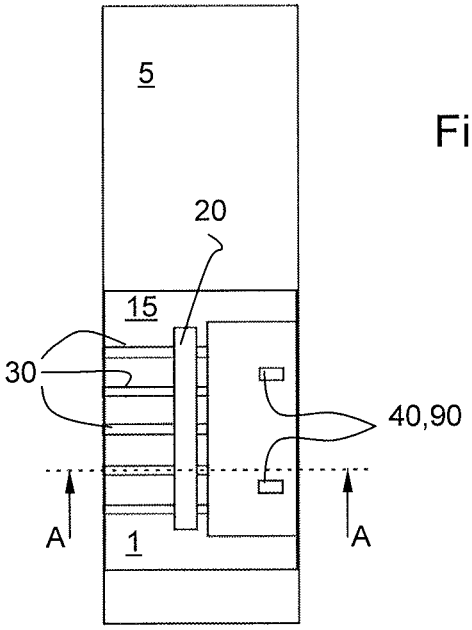
Fig. 2
Fig. 3
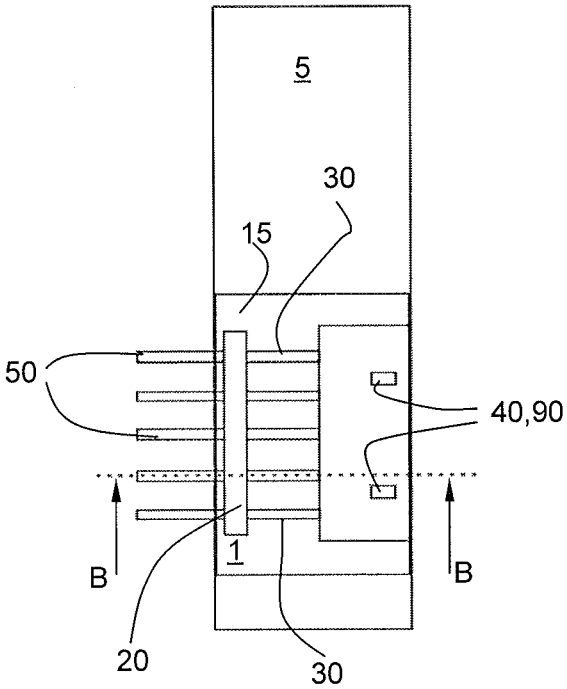

CONNECTION MODULE AND CONNECTION MODULE SYSTEM

CROSS-REFERENCE TO RELATED APPLICATIONS

This application is a continuation of International Patent Application No. PCT/EP2011/070971, filed Nov. 24, 2011, entitled CONNECTION MODULE AND CONNECTION MODULE SYSTEM, which claims priority to German Application DE 10 2010 063 978.8-34, filed Dec. 22, 2010, each of which is hereby incorporated by reference herein, in the entirety and for all purposes.

BACKGROUND

The present invention generally relates to a connection module and to a connection module system. Connection modules that connect a supply module or, respectively, an adjacent further connection module to a corresponding drive module at which the connection module is arranged are well-known in the art, e.g. Schneider Electric GmbH's servo amplifier system Lexium LXM 62. Therein, the connection between the connection module and the adjacent module or, respectively, the supply module is implemented by means of busbars or by means of cable connections. Both in the case of busbar connectors and cable connections, screw connections are applied in order to fix the cable connections or, respectively, the busbars. The screw connections may loosen due to vibrations or are during assembly many a time tightened using a not-adapted torque. This can lead to overwinding the screw connection and thus to damaging or self-loosening of the screw connection due to vibrations.

SUMMARY

The present invention provides a connection module with a durable electrical connection to an adjacent module or, respectively, to a further connection module or a supply module.

According to one embodiment of the invention, a connection module comprises a first connecting contact and a second connecting contact. The first and the second connecting contacts each comprise a contact element. The first contact element of the first connecting contact is arranged in a movable manner and the second contact element of the second connecting contact is arranged in a fixed manner. The second contact element of the second connecting contact is configured to provide a connection to a corresponding first contact element of an adjacent module. The second connecting contact comprises a spring terminal which is configured to press the corresponding first contact element of the adjacent module against the second contact element of the second connecting contact.

According to another aspect of the invention, the connection module comprises a first connecting contact and a second connecting contact. The first and the second connecting contacts each comprise a contact element. The first contact element of the first connecting contact is arranged in a movable manner and the second contact element of the second connecting contact is arranged in a fixed manner. The second contact element of the second connecting contact is configured to provide a connection to a corresponding first contact element of an adjacent module. The second connecting contact comprises a spring terminal which is configured to press the corresponding first contact element of the adjacent module against the second contact element of the second connecting contact. The second connecting contact comprises an actuating device which is arranged at the spring terminal and provides an actuating force for actuating the spring terminal.

According to one embodiment of the invention, a connection module system comprises at least one first connection module and one second connection module. Each connection module comprises a first connecting contact and a second connecting contact. The first and the second connecting contacts each comprise a contact element. A first contact element of the first connecting contact is arranged in a movable manner and the second contact element of the second connecting contact is arranged in a fixed manner. The first connecting contact of the first or, respectively, of the second connection module is configured to be inserted into the second connecting contact of the second or, respectively, of the first connection module and to provide an electrical contact between the first and the second connection module. The second connecting contact comprises a spring terminal. The spring terminal of the first or, respectively, of the second connection module is configured to press the first contact element of the first connecting contact of the second or, respectively, of the first connection module against the second contact element of the second connecting contact of the first or, respectively, of the second connection module.

According to one embodiment of the invention, a connection module system comprises a supply module and a connection module. The supply module provides a connection to a control unit and/or a power source. The connection module comprises a first connecting contact. The first connecting contact comprises a first contact element. The first contact element is arranged in a movable manner. The supply module comprises a second connecting contact. A second contact element of the second connecting contact is arranged in a fixed manner. Each second connecting contact comprises a spring terminal. The first connecting contact is configured to be inserted into the second connecting contact and to provide an electrical contact between the supply module and the connection module. The spring terminal is configured to press the first contact element against the second contact element.

BRIEF DESCRIPTION OF THE DRAWINGS

FIG. 2 shows a schematic view of the connection module depicted in FIG. 1 in an unlocked state;

FIG. 3 depicts the connection module shown in FIG. 2 in a locked state;

DETAILED DESCRIPTION

In the following, reference is made to embodiments of the invention. However, it should be understood that the invention is not limited to specific described embodiments. Instead, any combination of the following features and elements, whether related to different embodiments or not, is contemplated to implement and practice the invention. Furthermore, in various embodiments the invention provides numerous advantages over the prior art. However, although embodiments of the invention may achieve advantages over other possible solutions and/or over the prior art, whether or not a particular advantage is achieved by a given embodiment is not limiting of the invention. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Figure 1:
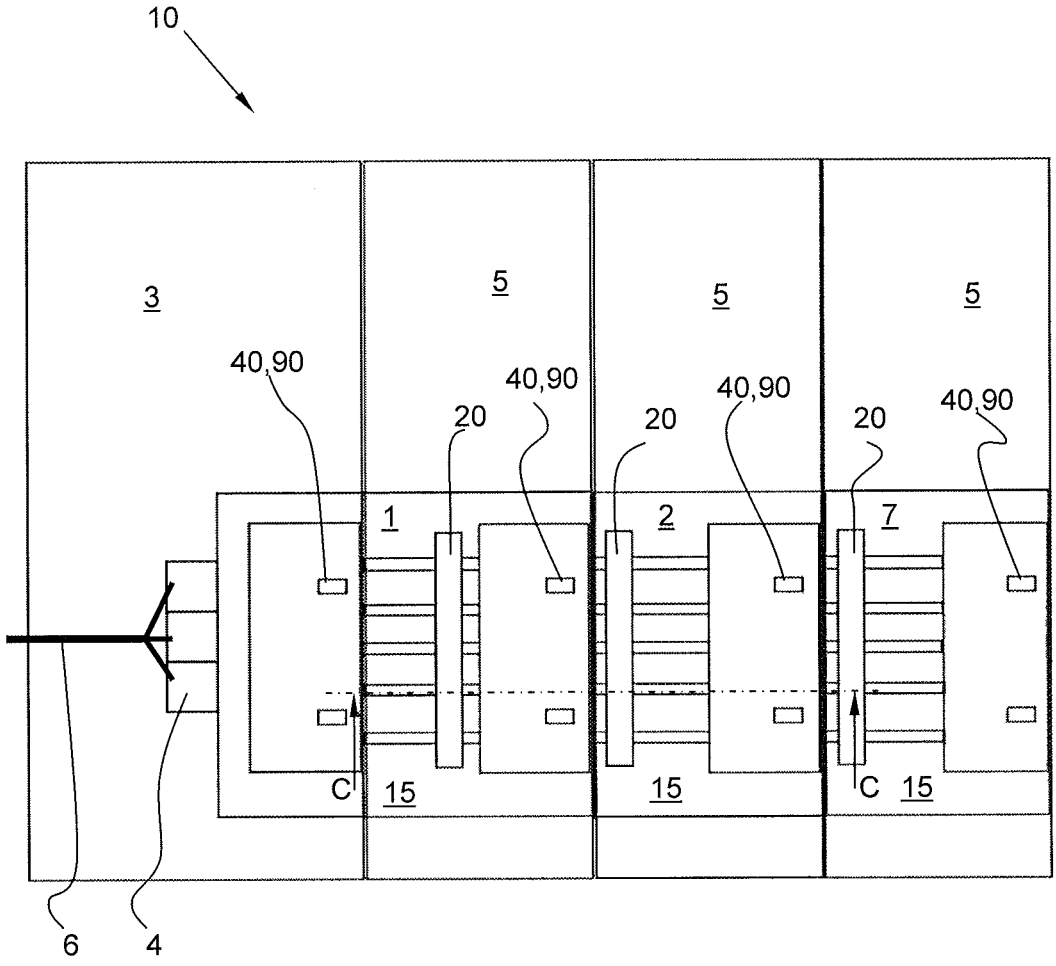
FIG. 1 depicts a schematic view of a module system having a supply module, three drive modules and three connection modules.

FIG. 1 shows a module system 10 having a first connection module 1. FIG. 2 shows a schematic top view onto the first connection module 1 depicted in FIG. 1 in an unlocked state and FIG. 3 shows the first connection module 1 depicted in FIG. 1 in a locked state.

The module system 10 further comprises a drive module 5 arranged on the rear side of the first connection module 1, a supply module 3 arranged on the left-hand side of the connection module 1 and an adjacent module 2 arranged on the right-hand side of the connection module 1. On the rear side of the adjacent module 2, a further drive module 5 is also arranged. The drive module 5 is further connected to not-depicted motors of e. g. a production line. In addition, the supply module 3 comprises a connection terminal 4 for connecting the connection terminal 4 to connection lines 6. The connection lines 6 in this context provide a connection to a power supply and/or to a control unit.

The first connection module 1 provides an electrical connection between the connection module 1, the drive module 5 and the supply module 3 and, as the case may be, the adjacent module 2 in order to supply the drive module 5 and the adjacent module 2 with current and/or control signals. In the embodiment, the adjacent module 2 is configured as second connection module 2 analogously to the first connection module 1 and it is connected to the supply module 3 via a further adjacent module 7 arranged at the right-hand side via the second connection module 2 and the first connection module 1. Of course, the further adjacent module 7 may be configured corresponding to the first connection module 1 so that the connection modules 1, 2, 7 provide a series of connection modules 1, 2, 7 for connecting the drive modules 5 arranged at them to the supply module 3.

The connection modules 1, 2, 7 each comprise a housing 15 and a slide 20 which is guided in guiding grooves 30 of the housing 15. Adjacent to the guiding grooves 30, actuating devices 40, 90 are provided which are in large part obscured by a housing 15.

The slide 20 is configured to be slid along the guiding grooves 30 of the housing 15 and to lock and unlock a contact system for electrically connecting the supply module 3 to the connection module 1. In this context, the slide 20 is shown in an unlocked and not-contacting position in FIG. 2, i. e. slinging onto the right-hand side in the guiding groove, and in FIG. 3 in a locked and contacting position, i. e. slinging onto the left-hand side in the guiding groove.

Figure 4:
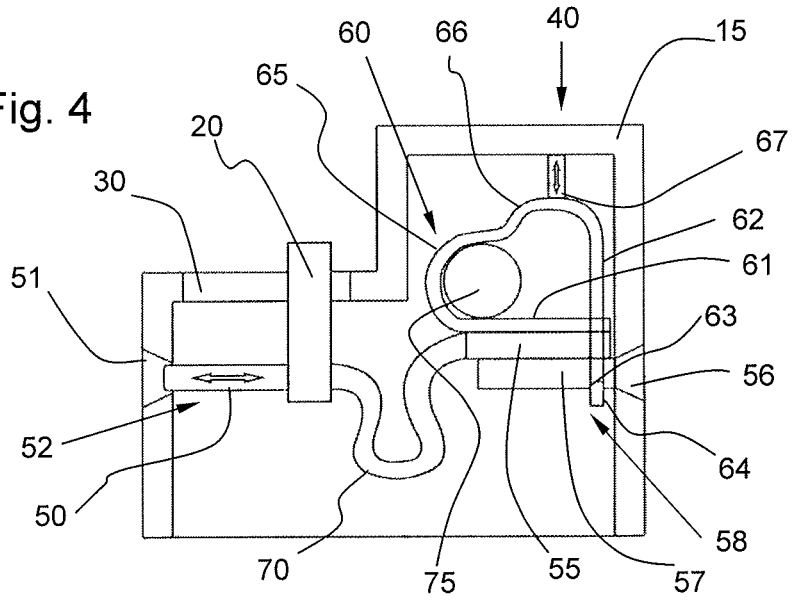
FIG. 4 shows a sectional view through the connection module depicted in FIGS. 1 to 3 in a not-locked state.
Figure 5:
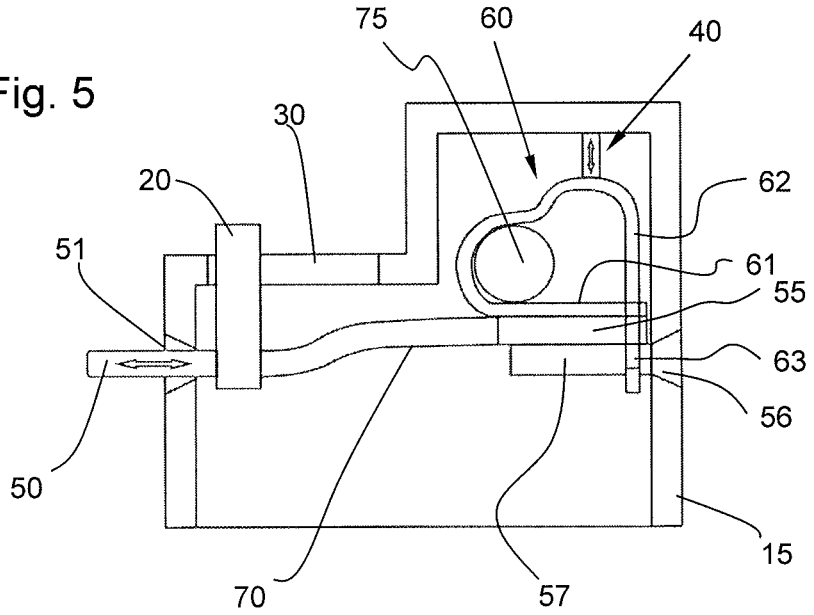
FIG. 5 shows a sectional view of the connection module shown in FIG. 4 in a locked state.

FIG. 4 shows a sectional view along the intersection line A-A through the first connection module 1 shown in FIG. 2. FIG. 5 shows a sectional view along the intersection line B-B of the first connection module 1 shown in FIG. 3.

The housing 15 of the first connection module 1 comprises a first opening 51 and a connecting contact 52 arranged at the first opening 51 and a second opening 56 arranged opposite to the first opening 51 and a second connecting contact 58 arranged at the second opening 56.

The first connecting contact 52 in this context comprises a first contact element 50 that is connected to the slide 20 and is configured as a contact plug. When the slide 20 is actuated and slid along the guiding groove 30 in the direction of arrow from an unlocked position, as shown in FIG. 4, into a locked position, as shown in FIG. 5, the first contact element 50 is carried along by the slide 20 so that the first contact element 50 protrudes from the housing 15 in a locked position of the slide 20.

The second connecting contact 58 comprises a spring terminal 60, a first actuating device 40 which is symbolically depicted in FIGS. 4 and 5, a second contact element 55 and a receiving area 57. The receiving area 57 of the connecting contact directly connects to the second opening 56 of the second connecting contact 58. The second contact element 55 abuts above the receiving area 57, the second contact element 55 being connected to the spring terminal 60. The spring terminal 60 is supported by the contact element 55 during actuation of the actuating device 40. Further, the second contact element 55 is connected to the first contact element 50 via a connection that is configured as a flexible wire 70.

The spring terminal 60 comprises a first section 61 and a second section 62, wherein the second section 62 of the spring terminal 60 is arranged perpendicularly to the first section 61. A first bend 65 and a second bend 66 are arranged between the two sections 61, 62. The bends 65, 66 connect the two sections 61, 62 and provide a spring load by means of their implementation. Further, an actuating surface 67 is provided externally at the second bend 66 of the spring terminal 60 in order to vertically push down the second section 62 of the spring terminal 60 by means of the actuating device 40, 90. In its end portion, the second section 62 comprises a clamp section 64 and a clamp opening 63 attached to it, the clamp opening 63 in the unloaded state of the spring terminal 60 only partly overlapping with the second opening 56 so that a passage cross-section at the spring terminal 60 is reduced in the area of the clamp opening 63.

In the depicted embodiment, the spring terminal is configured as tension-spring terminal 60 and attached in the housing 15 of the connection module 1 by means of a retaining element 75 which is enclosed by the spring terminal 60. However, it is also conceivable to use other retaining elements instead of the shown embodiment of the retaining element 75 for attaching the spring terminal 60. It is in particular e. g. conceivable to attach the spring terminal 60 in the housing 15 by means of a plurality of retaining lugs.

In the embodiment, the slide 20 is configured to simultaneously actuate and carry along a plurality of first contact elements 50 arranged next to each other beneath the guiding groove 30. When the slide 20 is slid from the unlocked position into the locked position, the first contact elements 50 of the first connecting contacts 52 are inserted into the receiving area 57 of the second connecting contact 58 so that a simultaneous contacting between a plurality of first contact elements 50 of the first connecting contact 52 arranged in parallel with a plurality of respectively corresponding second contact elements 55 of the second connecting contact 58 takes place. The advantage thereof is that the connection module 1 may be electrically connected to the supply module 3 in a fast and reliable manner. Correspondingly, the adjacent module 2 may also be quickly connected to the connection module 1 in the same manner.

Figure 6:
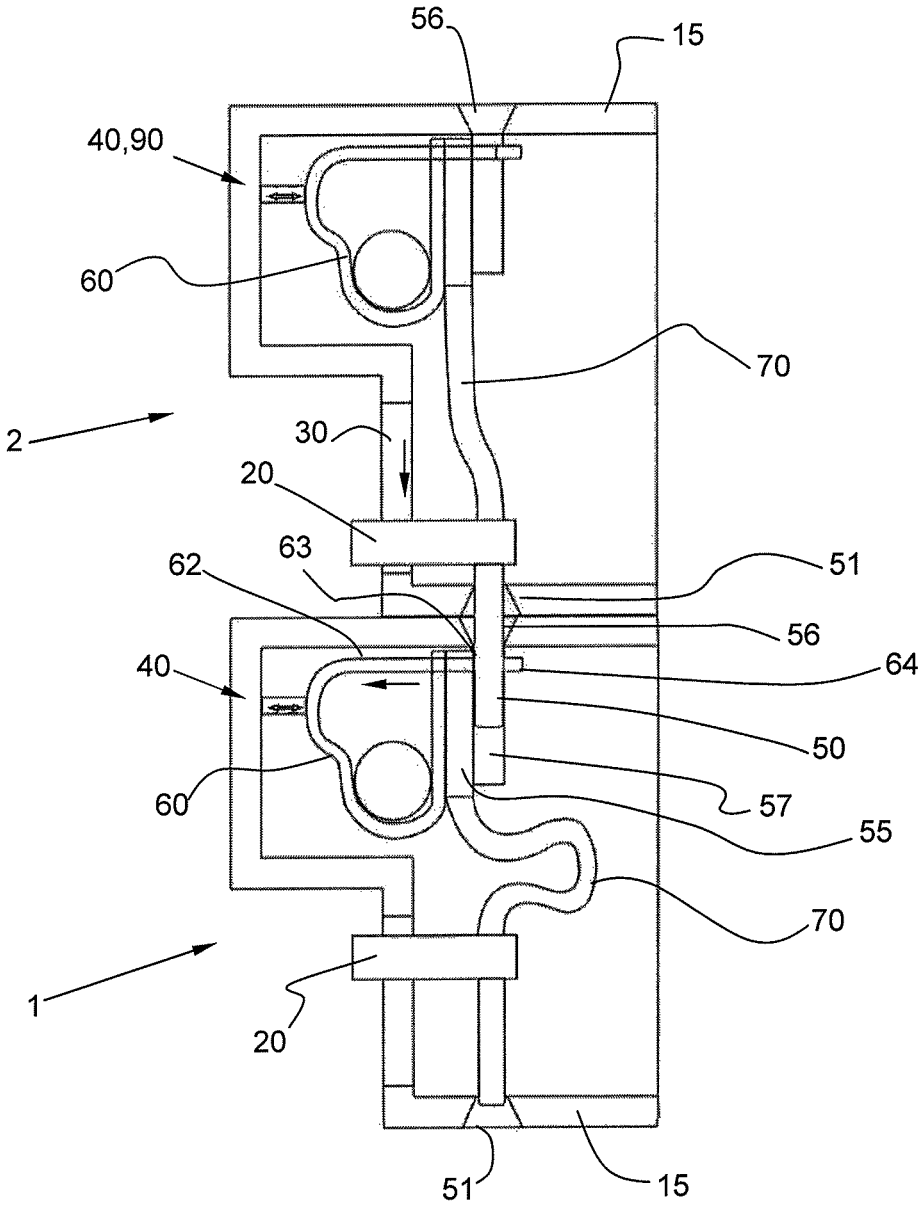
FIG. 6 depicts a sectional view through the module system shown in FIG. 1.

FIG. 6 shows a schematic sectional view along an intersection line C-C shown in FIG. 1 through the connection module 1 and the neighboring adjacent module 2. In the embodiment, the adjacent module 2 is configured as second connection module 2 in the same manner as the first connection module 1. In this context, the slide 20 of the first connection module 1 is in an unlocked position so that the first contact element 50 of the first connecting contact 52 is completely absorbed in the housing 15 of the first connection module 1.

The slide 20 of the second connection module 2 or, respectively, of the adjacent module 2 is in a locked position so that the corresponding first contact element 50 of the adjacent module 2 protrudes from the housing 15 of the adjacent module 2 and into the receiving area 57 of the first connection module 1. In this context, the corresponding first contact element 50 of the adjacent module 2 is guided through the clamp opening 63 of the spring terminal 60 and, at a reduction of the passage cross-section of the clamp opening 63, pushed upwards through the clamp section 64 of the second section 62 in the direction of the second contact element 55 and pressed against the second contact element 55. Due to this pressing, an electrical connection is provided between the first contact element 50 of the adjacent module 2 and the second contact element 55 of the connection module 1.

In order to provide a connection between the first connection module 1 and the adjacent module 2, at first the second section 62 is pushed downwards opposite to the direction of arrow drawn in in FIG. 6 by means of the actuating device 40, 90 so that the clamp opening 63 of the spring terminal 60 is arranged in the receiving area 57 of the second connecting contact 58 and essentially overlaps with the second opening 56. This state is maintained until the first contact element 50 is completely inserted. While the first contact element 50 is inserted into the receiving area 57, the second section 62 of the spring terminal 60 is constantly pushed downwards, thus allowing for the insertion of the first contact element 50 into the opening 63 of the spring terminal 60. Thereupon, the slide 20 of the adjacent module 2 may be slid to the left so that the first contact element 50 of the adjacent module 2 may be slid out of the housing 15 of the adjacent module 2, via the second opening 56 of the housing 15 of the connection module 1 into the connection module 1 and guided through the passage opening 63 of the spring terminal 60.

If the slide 20 slings onto the left-hand-side end of the guiding groove 30, the first contact element 50 is in the locked position. In order to provide a reliable electrical connection between the first contact element 50 and the second contact element 55 of the second connecting contact 58, the tensioning or, respectively, the actuation of the spring terminal 60 is neutralized by the actuating device 40, 90 so that the second section 62 of the spring terminal 60 presses the first contact element 50 of the adjacent module 2 upwards against the second contact element 55 of the second connecting contact 58 of the connection module 1. The first contact element 50 is clamped at the spring terminal 60 by means of the clamp section 64 at the end of the second section 62 of the spring terminal 60 in such a way that pulling the first contact element 50 out of the second connecting contact 58 is prevented. Additionally, pulling the first contact element 50 out of the second connecting contact 58 may be prevented when the clamp section 64 carves into the contact element 50 so that by means of carving edges at the first contact element 50 that result from carving the clamp section 64 into the first contact element 50, pulling out the first contact element 50 is additionally prevented.

In order to disconnect the connection module 1 and the adjacent module 2, the spring terminal 60 first must be tensioned by means of the actuating device 40, 90, thus pushing downwards the second section 62 of the spring terminal 60. Thus, the clamping by the clamp section 64 is neutralized at the first contact element 50 and the clamp opening is enlarged so that the slide 20 of the adjacent module 2 may be slid back into the unlocked position, wherein the first contact element 50 may be pulled out of the second connecting contact 58 of the first connection module 1.

In the same manner as the electrical connection between the connection module 1 and the adjacent module 2 is established and also disconnected again, an electrical connection between the connection module 1 and the supply module 3 shown in FIG. 1 is established and disconnected again. In this context, the first connecting contact 52 of the connection module 1 is inserted into the corresponding second connecting contact 58 of the supply module 3 in the same manner as described above. Disconnecting the first connecting contact 52 from the supply module 3 is carried out in the same manner as described above. This allows for a vibration-resistant and simple connection of the supply module 3 to the first connection module 1.

The same also applies to the two modules 2, 7 if the second connection module 2 and the further adjacent module 7 are constructed in the same way, so that a supply chain for the various drive modules arranged at the connection modules 1, 2, 7 may be provided which may be actuated in a fast and simple manner and wherein assembly errors may be prevented at the same time.

In the embodiment, the flexible connection between the first connecting contact 52 and the second connecting contact 58 is implemented by means of the flexible wire 70. For the flexible wire 70, copper bands or copper strands or electrically conductive wire meshes are in particular suitable which are attached to the respectively corresponding contact element 50, 55 with their respective ends. This configuration allows for a flexible, durable connection of the two connecting contacts 52, 58 of the first connection module 1 which may be actuated many times.

However, as an alternative it is also conceivable to develop a busbar system instead of the flexible wire 70 in order to electrically connect the first contact element 50 to the second contact element 55. Other embodiments of the flexible connection between the first connecting contact 52 and the second connecting contact 58 are also conceivable.

In FIGS. 4 to 6, the openings 51, 56 of the housing 15 of the first connection module 1 or, respectively of the adjacent module 2 are configured in a rectangular manner, wherein the cross-section is reduced from the outside to the inside in order to facilitate the insertion of the first contact element 50 into the corresponding module. However, alternatively it is also conceivable that the openings 51, 56 comprise a cylindrical longitudinal cross-section instead of the rectangular longitudinal cross-section. Other cross-sections are also conceivable, wherein the cross-section advantageously reduces from the outside to the inside in order to facilitate the insertion of the first contact element 50 into the second opening 56.

Figure 7:
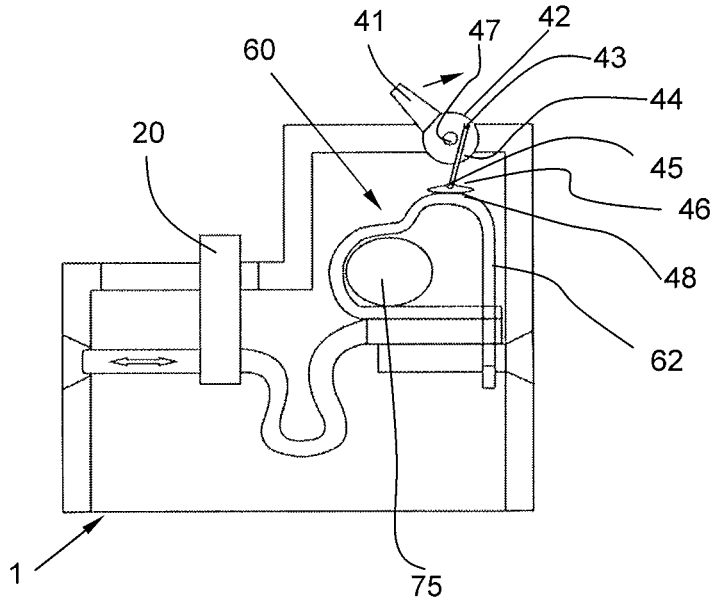
FIG. 7 shows the connection module with a first embodiment of the first actuating device for actuating a spring terminal.

FIG. 7 shows a schematic sectional view along the intersection line A-A through the first connection module 1 depicted in FIG. 2 having a first embodiment of a first actuating device 40. The first actuating device 40 comprises a first shaft 42 to which a first lever 41 is attached at the peripheral side. The first shaft 42 is mounted in a rotatable manner around a rotational axis 47 which is aligned diagonally with regard to the sliding direction of the slide 20. A first pivot point 43 is provided eccentrically, lying radially at the outside of the first shaft 42, the first pivot point 43 connecting the first shaft 42 to a connecting rod 44. At the other end of the connecting rod 44 at a second pivot point 45, the connecting rod 44 is connected to a pressure frame 46. The pressure frame 46 comprises a pressure surface 48 facing towards the spring terminal 60, the pressure surface 48 being assigned to the actuating surface 62 of the spring terminal 60.

In the embodiment, the spring terminal 60 is in an unloaded state so that the first contact element 50 of the adjacent module 2 or, respectively, of the second connection module 2 cannot be inserted through the passage opening 63 of the spring terminal 60. In order to release this interlock, the first lever 41 of the first actuating device 40 is pivoted clockwise around the rotation axis 47 in the direction of arrow so that the first pivot point 43 is twisted in the direction of the spring terminal 60. Therein, an actuating force is provided via the first lever 41. The actuating force is thereby transmitted to the connecting rod 44 via the first shaft 42. The connecting rod 44 transmits the actuating force on to the pressure frame 46 which as a result thereof presses on the actuating surface 62 of the spring terminal 60 with its pressure surface 48 and shifts the second section 62 of the spring terminal 60 downwards. In the process, the clamp opening 63 is slid into the receiving area 57 in such a way that the passage cross-section of the clamp opening 63 essentially overlaps with the second opening 56 of the housing 15 and that the first contact element 50 of the first connecting contact 52 may be inserted into the second connecting contact 58. Here, it is advantageous when the first actuating device 40 comprises not-depicted fastening elements in order to fix the first lever 41 in the end positions, in order to thus facilitate connecting the connection module 1 to the adjacent module 2.

Figure 8:
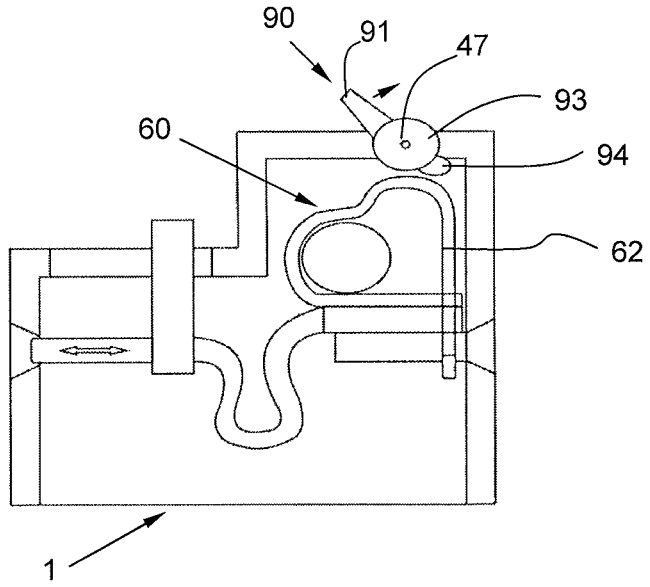
FIG. 8 shows a schematic view of a second actuating device.

FIG. 8 shows a sectional view along the intersection line A-A depicted in FIG. 2 through the connection module 1 having a second actuating device 90. The second actuating device 90 comprises a second lever 91 which is connected to a second shaft 93. The second shaft 93 is mounted around the rotation axis 47 in a rotatable manner and comprises a cam 94 on the peripheral side. In FIG. 8, the second actuating device 90 is depicted in a not-actuated state so that the spring terminal 60 either prevents the insertion of the first contact element 50 or presses the first contact element 50 against the second contact element 55. The actuating surface 67 of the spring terminal 60 is contacted by the cam 94 in the actuated state when the second lever 91 is actuated so that the second section 62 of the spring terminal 60 is pushed downwards.

By means of the embodiments of the actuating device 40, 90 shown in FIGS. 7 and 8, the spring terminal 60 may easily be actuated in order to thus allow for the insertion of the first contact element 50 into the second connecting contact 58 or, respectively, to press the first contact element 50 against the second contact element 55 of the second connecting contact 58 and thus to provide an electrical connection between the adjacent module 2 and the connection module 1. In this context, the shaft 42, 93 may be guided via multiple second connecting contacts 58 in order to simultaneously actuate a plurality of spring terminals 60 by means of the actuating device 40, 90 so that the insertion of multiple first contact elements 50 of the first connecting contact 52 arranged in parallel is simultaneously enabled by means of the actuated slide 20. In this context, it is possible that only one lever 41, 91 is provided by means of which the shaft 42, 93 is rotated, the respective actuating surface 62 of the respective spring terminal 60 of the second connecting contact 58 being actuated by means of the cam 94 or, respectively, by means of the pressure frame 46.

Figure 9:
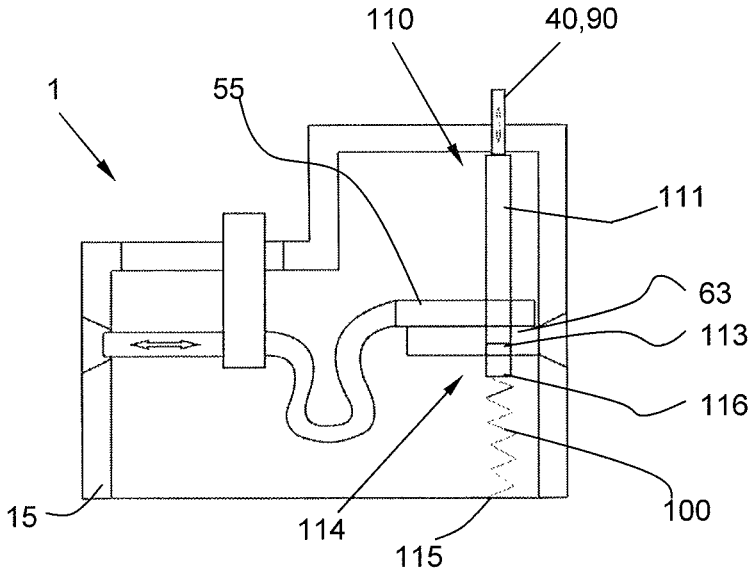
FIG. 9 depicts a schematic view of an alternative spring terminal.

FIG. 9 depicts a sectional view through the connection module 1 along the intersection line A-A shown in FIG. 2 in an alternative embodiment. The second connecting contact 58 comprises an alternative spring terminal 110 instead of the spring terminal 60. The alternative spring terminal 110 in this context comprises a pressure spring 100 which is arranged at the housing 15 with a first end 115. A clamping device 114 is assigned to a second end 116 of the pressure spring 100. The clamping device 114 comprises a clamp surface 113 which is arranged opposite to the second contact element 55 and forms the clamp opening 63. In order to actuate the alternative spring terminal 110 by means of the actuating device 40, 90, a plunger 111 is further provided which connects the actuating device 40, 90 to the alternative spring terminal 110.

The operating mode of the alternative spring terminal 110 is similar to the spring terminal 60 depicted in FIGS. 3 to 8. When the actuating device 40, 90 is actuated, the actuating device 40, 90 pushes the plunger 111 downwards so that the receiving area 57 of the alternative spring terminal 110 is released. The release of the alternative spring terminal 110 allows for the first contact element 50 of the first connecting contact 52 to be inserted or for the first contact element 50 to be pulled out of the alternative spring terminal 110 of the second connecting contact 58 through the clamp opening 63. When the actuation of the actuating device 40, 90 is neutralized, the pressure spring 100 pushes the clamp surface 113 of the clamping device 114 upwards and presses the inserted (not depicted) first contact element 50 of the adjacent module 2 against the second contact element 55 of the second connecting contact 58. Therein, by pressing the inserted (not depicted) first contact element 50 of the adjacent module 2 against the second contact element 55 of the second connecting contact 58, an electrical connection between the first contact element 50 and the second contact element 55 is provided. Also, pulling the first contact element 50 out of the receiving area 57 is prevented by the clamp surface 113.

Further, it is also conceivable that, just as the clamp section 64 of the spring terminal 60 shown in FIGS. 4 to 8, the clamp surface 113 clamps the first contact element 50 in such a way and/or carves into the corresponding first contact element 50 of the first connecting contact 52 in such a way that pulling the first contact element 50 out of the second connecting contact 58 is additionally prevented.

The embodiments of connection modules 1 and their components explained by means of the figures are preferred or, respectively, exemplary embodiments of the invention. Apart from the described and depicted embodiments, further embodiments which may comprise further variations or, respectively, combinations of the described features are conceivable.

It is in particular pointed out that the depicted adjacent module 2 may be identical in construction to the described first connection module 1. However, it is alternatively conceivable that the adjacent module 2 comprises a different actuating device 40, 90 in order to press the received contact elements 50 against the innate second connecting contact 58 and to provide an electrical connection. It is also conceivable that the first connection module 1 is connected to the supply module 3 in this manner so that a vibration-resistant and easily mountable connection between the individual modules 1, 2, 3, 7 of the module system 10 may be provided.

Alternatively, it is conceivable to additionally provide openings, e. g. in the form of slots, in the housing 15 of the connection module 1, 2, 7 instead of the actuating device 40, 90 depicted in the figures in order to actuate and pre-load the spring terminal 60, 110 through the openings by means of a tool, in particular by means of a screwdriver. In this context, the spring terminal 60, 110 of the second connecting contact 58 may be actuated directly by means of the tool or the transmission of force from the tool to the spring terminal 60, 110 may be carried out via a transmission medium. In this context, the transmission medium may also be configured to provide the force to multiple spring terminals 60, 110 of the second connecting contact 58 for simultaneously actuating the spring terminals 60, 110.

Further, in the embodiment, the connection module 1, 2, 7 and the drive module are arranged in two separate housings. However, it is alternatively conceivable that the connection module 1, 2, 7 and the drive module 5 comprise a common housing or, respectively, that the connection module 1, 2, 7 is integrated into the housing of the drive module 5.

It is also pointed out that the alignment of the rotation axis 47 of the actuating device 40, 90 is exemplary. Of course, different alignments of the rotation axis 47 are also conceivable, wherein advantageously all spring terminals 60, 110 of the second connecting contact 58 may be actuated by means of the actuating device.

It is further pointed out that apart from the depicted tension-spring terminal 60 and pressure-spring terminal 110, other spring terminals are also conceivable. In this context, spring terminals which may be actuated in an array of multiple spring terminals by means of an actuating device 40, 90 are particularly advantageous in order to thus provide an electrical connection to the corresponding contact element of the connecting contact of the adjacent module.

The present invention provides a connection module with a durable electrical connection to an adjacent module or, respectively, to a further connection module or a supply module.

This configuration allows for a fast connection of the connection module to the adjacent module, wherein the electrical connection is reliably protected against shocks or unintentional loosening by means of the spring terminal. Further, the spring terminal safeguards a reliable contact between the contact element of the adjacent module and the first connecting contact as well so that contacting difficulties that bring about impeded fault diagnostics are prevented. Also a fast and reliable connection of the connection module to the supply module can be provided.

In a further embodiment, the spring terminal comprises a terminal opening through which the corresponding first contact element of the adjacent module may be guided, wherein in the unloaded state of the spring terminal the terminal opening comprises a reduceable passage cross-section and wherein subsequent to the insertion of the corresponding first contact element of the adjacent module, the terminal opening presses the contact element of the adjacent module against the second contact element of the second connecting contact due to the spring load of the spring terminal. This configuration safeguards a vibration-resistant connection between the first connecting contact of the connection module and the contact element of the adjacent module.

In a further embodiment, the spring terminal is configured as tension-spring terminal and comprises at least one bend section that comprises an externally-arranged actuating surface. When a compressive force is exerted onto the actuating surface, a clamping of the corresponding first contact element of the adjacent module at the second connecting contact is thus loosened. This configuration guarantees a simple loosening of the first contact element of the adjacent module from the second connecting contact or, respectively, from the connection module.

In a further embodiment, the spring terminal is configured as pressure-spring terminal, wherein a first end of the pressure spring is supported at the housing of the connection module and a second end of the pressure spring presses the first contact element of the adjacent module against the second contact element of the second connecting contact. This alternative embodiment of the spring terminal also safeguards a reliable and vibration-resistant contact between the first contact element of the adjacent module and the second connecting contact of the connection module.

In a further embodiment, the second connecting contact comprises an actuating device which is arranged at the spring terminal and provides an actuating force for actuating the spring terminal so that the clamping of the first contact element of the adjacent module at the second connecting contact may be loosened in a simple manner.

In a further embodiment, the actuating device comprises a shaft having a cam, the cam being configured to actuate the spring terminal. This configuration safeguards a simple actuation of the tension-spring terminal and the position of the actuating device may be indicated in a simple manner.

In a further embodiment, the actuating device comprises a shaft, a connecting rod which is eccentrically attached to the shaft, and a pressure frame connected to the connecting rod, wherein the actuating force is provided by means of a shaft. The connecting rod serves for transmitting the actuating force to the spring terminal, wherein the pressure frame is configured to actuate the spring terminal. This configuration allows for actuating the tension-spring terminal for loosening the clamping of the first contact element of the adjacent module in a simple manner.

In a further embodiment, the first connecting contact comprises a slide guided in a guiding groove of the housing, the slide being connected to the first contact element of the first connecting contact and actuating the first contact element of the first connecting contact. In this manner, a plurality of first contact elements of the first connecting contact may also be actuated easily and simultaneously.

In a further embodiment, the first connecting contact is embodied as a contact plug which is configured to provide an electrical connection to a corresponding second connecting contact of the adjacent module so that the first and second connecting contacts may be connected to each other in a simple manner.

In a further embodiment, the first connecting contact is connected to the second connecting contact by means of a connection in which their spacing varies, said connection being configured as a flexible wire. This configuration allows for a reliable electrical connection of the first connecting contact to the second connecting contact and prevents contacting difficulties due to corrosion or shocks.

While embodiments, including preferred embodiments, of the present invention are described herein, other and further embodiments of this invention may be devised without departing from the basic scope of the invention, the scope of the present invention being determined by the claims that follow.

The invention claimed is:

1. A connection module for supplying a drive module with electrical current, the connection module comprising a first connecting contact and a second connecting contact, wherein the first and the second connecting contacts each comprise a contact element, wherein the first contact element of the first connecting contact is arranged in a movable manner and the second contact element of the second connecting contact is arranged in a fixed manner, wherein the second contact element of the second connecting contact is configured to provide a connection to a corresponding first contact element of an adjacent module, wherein the second connecting contact comprises a spring terminal configured to press the corresponding first contact element of the adjacent module against the second contact element of the second connecting contact, wherein the second connecting contact comprises an actuating device which is arranged at the spring terminal and provides an actuating force for actuating the spring terminal, and wherein the actuating device comprises a shaft, a connecting rod eccentrically-attached to the shaft, and a pressure frame connected to the connecting rod, wherein the actuating force is provided by means of the shaft which is configured to transmit the actuating force for actuating the spring terminal to the pressure frame and wherein the pressure frame is configured to actuate the spring terminal.

2. The connection module according to claim 1, wherein the spring terminal comprises a clamp opening through which the corresponding first contact element of the adjacent module may be guided, wherein the clamp opening comprises a reduceable passage cross-section and is configured to press the first contact element of the adjacent module against the second contact element of the second connecting contact.

3. The connection module according to claim 1, wherein the spring terminal is configured as a tension-spring terminal and comprises at least one bend section which comprises an externally-arranged actuating surface, wherein when a pressure force is exerted onto the actuating surface of the spring terminal, a clamping of the corresponding first contact element of the adjacent module at the second connecting contact may be loosened.

4. The connection module according to claim 1, wherein the connection module comprises a housing, wherein the spring terminal is arranged in the housing, wherein the spring terminal is configured as pressure-spring terminal, wherein a first end of a pressure spring of the pressure-spring terminal is supported on the housing of the connection module and a second end of the pressure spring is configured to press the corresponding first contact element of the adjacent module against the second contact element of the second connecting contact.

5. A connection module for supplying a drive module with electrical current, the connection module comprising a first connecting contact and a second connecting contact, wherein the first and the second connecting contacts each comprise a contact element, wherein the first contact element of the first connecting contact is arranged in a movable manner and the second contact element of the second connecting contact is arranged in a fixed manner, wherein the second contact element of the second connecting contact is configured to provide a connection to a corresponding first contact element of an adjacent module, wherein the second connecting contact comprises a spring terminal which is configured to press the corresponding first contact element of the adjacent module against the second contact element of the second connecting contact, and wherein the connection module comprises a housing, wherein the first connecting contact comprises a slide guided in a guiding groove of the housing, wherein the slide is connected to the contact element of the first connecting contact and is configured to actuate the contact element of the first connecting contact.

6. The connection module according to claim 1, wherein the first connecting contact is configured as contact plug which is configured to provide an electrical connection to a corresponding second connecting contact of the adjacent module.

7. The connection module according to claim 1, wherein the second connecting contact is connected to the first connecting contact via a connection in which the spacing of the first and second connecting contacts varies, the connection being configured as flexible wire.

8. A connection module system having at least one first connection module and one second connection module, wherein each connection module comprises a first connecting contact and a second connecting contact, wherein the first and the second connecting contacts each comprise a contact element, wherein a first contact element of the first connecting contact is arranged in a movable manner and the second contact element of the second connecting contact is arranged in a fixed manner, wherein the first connecting contact of the first or, respectively, of the second connection module is configured to be inserted into the second connecting contact of the second or, respectively, of the first connection module and to provide an electrical contact between the first and the second connection module, wherein each second connecting contact comprises a spring terminal, wherein the spring terminal of the first or, respectively, of the second connection module is configured to press the first contact element of the first connecting contact of the second or, respectively, of the first connection module against the second contact element of the second connecting contact of the first or, respectively, of the second connection module, wherein the second connecting contact of the first or, respectively, of the second connection module comprises an actuating device which is arranged at the spring terminal and provides an actuating force for actuating the spring terminal, and wherein the actuating device comprises a shaft, a connecting rod eccentrically-attached to the shaft, and a pressure frame connected to the connecting rod, wherein the actuating force is provided by means of the shaft which is configured to transmit the actuating force for actuating the spring terminal to the pressure frame and wherein the pressure frame is configured to actuate the spring terminal.

9. The connection module system according to claim 8, wherein the spring terminal of the first or, respectively, of the second connection module comprises a clamp opening through which the corresponding first contact element of the second or, respectively, of the first connection module is guided, wherein the clamp opening comprises a reduceable passage cross-section and is configured to press the first contact element of the second or, respectively, of the first connection module against the second contact element of the second connecting contact.

10. The connection module system according to claim 8, wherein the spring terminal of the first or, respectively, of the second connection module is configured as a tension-spring terminal and comprises at least one bend section which comprises an externally-arranged actuating surface, wherein when a pressure force is exerted onto the actuating surface of the spring terminal, a clamping of the corresponding first contact element of the second or, respectively, of the first connection module at the second connecting contact may be loosened.

11. The connection module system according to claim 8, wherein the second connecting contact of the first or, respectively, of the second connection module comprises an actuating device which is arranged at the spring terminal and provides an actuating force for actuating the spring terminal.

12. A connection module system having a supply module and a connection module, wherein the supply module provides a connection to at least one of a control unit and a power source, wherein the connection module comprises a first connecting contact, wherein the first connecting contact comprises a first contact element, wherein the first contact element is arranged in a movable manner, wherein the supply module comprises a second connecting contact, wherein a second contact element of the second connecting contact is arranged in a fixed manner, wherein the second connecting contact comprises a spring terminal, wherein the first connecting contact is configured to be inserted into the second connecting contact and to provide an electrical contact between the supply module and the connection module, wherein the spring terminal is configured to press the first contact element against the second contact element, wherein the second connecting contact comprises an actuating device which is arranged at the spring terminal and provides an actuating force for actuating the spring terminal, and wherein the actuating device comprises a shaft, a connecting rod eccentrically-attached to the shaft, and a pressure frame connected to the connecting rod, wherein the actuating force is provided by means of the shaft which is configured to transmit the actuating force for actuating the spring terminal to the pressure frame and wherein the pressure frame is configured to actuate the spring terminal.

13. The connection module system according to claim 12, wherein the spring terminal comprises a clamp opening through which the corresponding first contact element of the second or, respectively, of the first connection module is guided, wherein the clamp opening comprises a reduceable passage cross-section and is configured to press the first contact element against the second contact element of the second connecting contact.

14. The connection module system according to claim 12, wherein the spring terminal is configured as a tension-spring terminal and comprises at least one bend section which comprises an externally-arranged actuating surface, wherein when a pressure force is exerted onto the actuating surface of the spring terminal, a clamping of the corresponding first contact element of the connection module at the second connecting contact of the supply module may be loosened.

* * * * *